US011305932B2

(12) United States Patent
Nakano et al.

(10) Patent No.: US 11,305,932 B2
(45) Date of Patent: Apr. 19, 2022

(54) ACUPUNCTURE NEEDLE PACKAGING CONTAINER

(71) Applicant: Seirin Corporation, Shizuoka (JP)

(72) Inventors: Ryoichi Nakano, Shizuoka (JP); Yuya Kaneko, Shizuoka (JP); Takuya Kobayashi, Shizuoka (JP)

(73) Assignee: SEIRIN CORPORATION, Shizuoka (JP)

( * ) Notice: Subject to any disclaimer, the term of this patent is extended or adjusted under 35 U.S.C. 154(b) by 0 days.

(21) Appl. No.: 17/161,664

(22) Filed: Jan. 29, 2021

(65) Prior Publication Data

US 2021/0403228 A1 Dec. 30, 2021

(30) Foreign Application Priority Data

Jun. 24, 2020 (JP) ..... JP2020-109048

(51) Int. Cl.
*B65D 85/24* (2006.01)

(52) U.S. Cl.
CPC ..... *B65D 85/24* (2013.01)

(58) Field of Classification Search
CPC ..... A61H 39/08; B65D 85/24; B65D 85/28
See application file for complete search history.

(56) References Cited

U.S. PATENT DOCUMENTS 4,106,621 A 8/1978 Sorenson
4,210,239 A * 7/1980 Takahashi ..... B65D 83/02 206/382
5,067,611 A * 11/1991 Hagmann ..... B65D 85/24 206/383
5,460,267 A 10/1995 Schiffer
7,784,612 B2 8/2010 Kanda et al.
10,562,698 B2 * 2/2020 Shen ..... A61B 50/33
(Continued)

FOREIGN PATENT DOCUMENTS

CN 209225763 U * 8/2019 ..... A61H 39/08
DE 3633664 A * 4/1988 ..... B65D 85/24
GB 1407399 A 9/1975
(Continued)

OTHER PUBLICATIONS

Extended European Search Report in EP Application No. 21154627.0, dated Jul. 22, 2021. 10pp.

*Primary Examiner* — Bryon P Gehman
(74) *Attorney, Agent, or Firm* — Hauptman Ham, LLP

(57) ABSTRACT

An acupuncture needle packaging container includes a container body having a plurality of storage recesses arranged side by side, each of the plurality of storage recesses configured to store an acupuncture needle, and a peripheral portion positioned higher than a bottom portion of the plurality of storage recesses; a sheet member configured to cover the container body; and a bendable portion crossing a longitudinal direction of a needle grip of the acupuncture needle. When the container body is bent, at the bendable portion, into an inverted V-shape and placed on a mounting surface, the container body has a rigidity to maintain the inverted V-shape. At a cross section of the bendable portion crossing the longitudinal direction, a side wall of the container body, with respect to a bottom portion of the container body, is oblique toward an outer side of the container body.

9 Claims, 8 Drawing Sheets

(56) References Cited

U.S. PATENT DOCUMENTS

2010/0089784 A1 4/2010 Kanda et al.

FOREIGN PATENT DOCUMENTS

| | | | | | |
|---|---|---|---|---|---|
| JP | H664675 | A | | 3/1994 | |
| JP | 3163634 | U | * | 10/2010 | ..... B65D 85/24 |
| JP | 4875157 | B2 | | 2/2012 | |
| WO | 2008149457 | A1 | | 12/2008 | |

* cited by examiner

ACUPUNCTURE NEEDLE PACKAGING CONTAINER

RELATED APPLICATION

The present application claims priority to Japanese Application Number 2020-109048 filed Jun. 24, 2020, the disclosure of which is hereby incorporated by reference herein in its entirety.

TECHNICAL FIELD

The instant application relates to an acupuncture needle packaging container, and in particular to an acupuncture needle packaging container having good usability.

BACKGROUND TECHNOLOGY

There is an acupuncture needle packaging container that can store a plurality of acupuncture needles and can be opened at once according to the number of acupuncture needles to be used, for example, as described in JP 4875157.

The acupuncture needle packaging container is a packaging container (blister package) composed from a container body and a sheet member detachably attached on a flat surface thereof, wherein a play not attached with the sheet member is provided at an outer frame portion of the container body on one end portion side of the packaging container (blister package).

SUMMARY

Problems to be Solved

In the above-mentioned acupuncture needle packaging container, for example, approximately half of the sheet member is peeled from the container body, the container body is bent, and the bent inverted V-shaped container body can be placed on a mounting surface of, for example, a table; however, when placed on a mounting surface such as a table, the packaging container is soft without stiffness and not created with the intention of standing in an inverted V-shape, so the mounted state is not stable and the removal of acupuncture needles is unstable. In addition, when bending the container body, the bending part is arbitrary, and if the needle body of the acupuncture needle is located at the bending point, the needle body is inadvertently bent causing a problem of damaging the needle body and the acupuncture needle could not be used.

The present application is to provide an acupuncture needle packaging container considering the above-mentioned problems.

Means for Solving Problems

An acupuncture needle packaging container according to at least one embodiment includes a container body having a plurality of storage recesses arranged side by side for storing acupuncture needles, and a peripheral portion positioned higher than a bottom portion of the storage recesses; a sheet member configured to cover the container body and attached to the peripheral portion; and an easily-bending portion crossing a longitudinal direction of a needle grip of the acupuncture needle stored in the storage recesses and provided on the container body below the needle grip. The acupuncture needles are at least embedded and stored in the storage accesses. In a case in which the container body is bent through the easily-bending portion and the bent inverted V-shaped container body is placed on a mounting surface, the container body has a rigidity to maintain the inverted V-shape. At a cross section of the easily-bending portion crossing the longitudinal direction of the acupuncture needle, a side wall of the container body, with respect to a bottom portion of the container body, is formed obliquely toward an outer side of the container body.

Further, an acupuncture needle packaging container according to at least one embodiment includes a container body having a plurality of storage recesses arranged side by side for storing acupuncture needles, and a peripheral portion positioned higher than a bottom portion of the storage recesses; a sheet member configured to cover the container body and attached to the container body, and an easily-bending portion crossing a longitudinal direction of a needle grip of the acupuncture needle stored in the storage recesses and provided on the container body below the needle grip. A joining portion between the container body and the sheet member includes a peripheral joining portion being a part of the joining portion between the sheet member and the peripheral portion of the container body, and a crossing direction joining portion being a part of the joining portion provided on an inner side of the peripheral joining portion and provided in a direction crossing the longitudinal direction of the needle grip of the acupuncture needle. The easily-bending portion is positioned on a side farther than the crossing direction joining portion when viewed from a needle tip of the acupuncture needle stored in the storage recesses. At the joining portion wherein the sheet member is peeled from the container body along the longitudinal direction of the needle grip of the acupuncture needle and reaches the easily-bending portion, the peripheral joining portion is positioned on an outer side of the crossing direction joining portion.

Further, in an acupuncture needle packaging container according to at least one embodiment, the crossing direction joining portion includes a joint portion joined to the peripheral joining portion.

An acupuncture needle packaging container according to at least one embodiment includes guiding means configured to guide peeling of the sheet member in the longitudinal direction of the acupuncture needle stored in the storage recesses by having an end portion of the sheet member protruding from the container body on a side farther from the needle body of the acupuncture needle, and having a protrusion amount, in a width direction of the sheet member, of a central portion of the end portion from the container body being large compared to a protrusion amount, in the width direction of sheet member, of both end portions of the end portion of the sheet member.

In an acupuncture needle packaging container according to at least one embodiment, the needle grip of the acupuncture needle stored in the storage recesses is exposed by peeling the sheet member in a peeling direction from the needle grip of the acupuncture needle stored in the container body toward the needle body, then bending the easily-bending portion of the container body in a direction opposite to the peeling direction of the sheet member, and placing the container body being bent in an inverted V-shape on a mounting surface.

In an acupuncture needle packaging container according to at least one embodiment, in a case in which the container body is bent through the easily-bending portion and the bent inverted V-shaped container body is placed on a mounting surface, the container body has a rigidity to maintain the inverted V-shape, and a stopper is provided at the storage recesses, and by the stopper, a movement toward a leading end side of the needle body of the acupuncture needle stored in the storage recesses is prevented.

Effects

According to the acupuncture needle packaging container according to at least one embodiment, the bent container body having a stiffness can be stably placed on the mounting surface in the inverted V-shape, and the exposed needle grip of the acupuncture needle stored in the storage recesses can be easily grasped by hand, and at the cross section of the easily-bending portion crossing the longitudinal direction of the acupuncture needle, the side wall of the container body, with respect to the bottom portion of the container body, is formed obliquely toward an outer side of the container body so that the container body can be bent while maintaining some strength, and in addition, the easily-bending portion provided on the container body is positioned below the needle grip of the acupuncture needle, instead of the needle body, so that at the portion bent, a load is applied to the needle grip of the acupuncture needle to protect the needle body.

Further, according to the acupuncture needle packaging container according to at least one embodiment, when the sheet member is peeled and when the peeled sheet member reaches the crossing direction joining portion, an opening resistance increases and a warning against the peeling action is urged to possibly stop the peeling action so that an exposure of the needle body of the acupuncture needle can be prevented.

Further, according to the acupuncture needle packaging container according to at least one embodiment, because the crossing direction joining portion includes a joint portion joined to the peripheral joining portion, compared to the crossing direction joining portion not joined to the peripheral joining portion, an opening resistance further increases and a warning against the peeling action is urged to possibly stop the peeling action so that an exposure of the needle body of the acupuncture needle can be prevented.

Further, according to the acupuncture needle packaging container according to at least one embodiment, the fingers of the hand can be guided to a portion wherein a protrusion amount is large and can be appropriately peeled.

Further, according to the acupuncture needle packaging container according to at least one embodiment, the bent container body having a stiffness can be stably placed on the mounting surface in the inverted V-shape, and the exposed needle grip of the acupuncture needle stored in the storage recesses can be easily grasped by hand.

Further, according to the acupuncture needle packaging container according to at least one embodiment, by the stopper, a movement toward a leading end side of the needle body of the acupuncture needle stored in the storage recesses is prevented and a leading end of the needle body of the acupuncture needle can be protected.

DETAILED DESCRIPTION

An acupuncture needle packaging container according to at least one embodiment of the present application will be described with reference to FIGS. 1 to 14.

Figure 1:
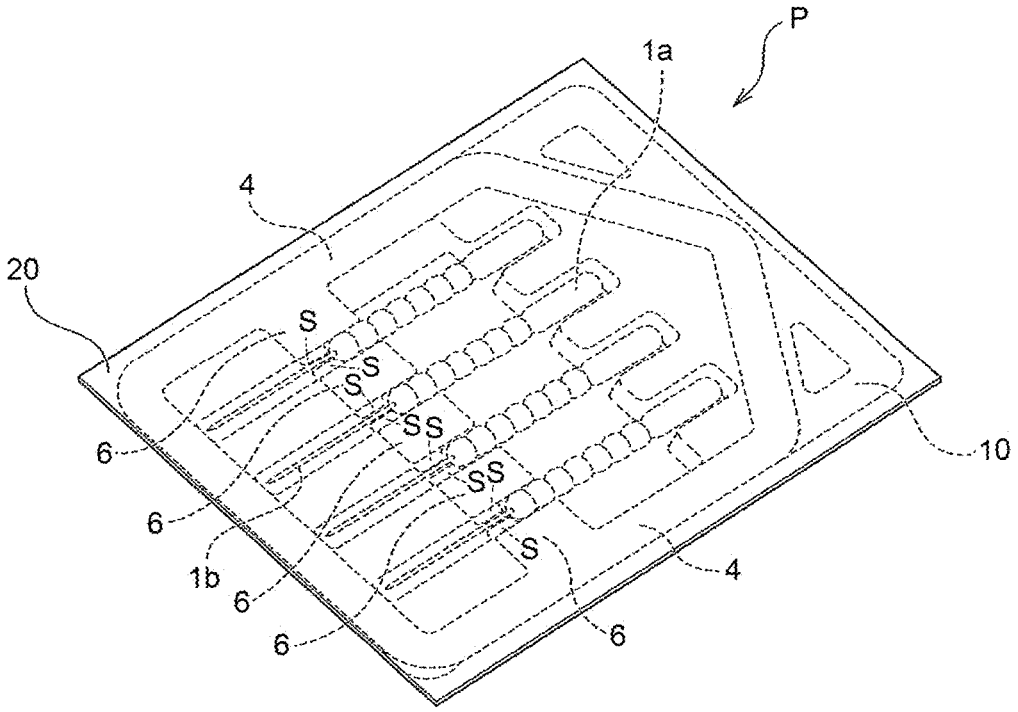
FIG. 1 is a schematic perspective view of an acupuncture needle packaging container according to at least one embodiment of the present application, wherein a joining portion between a container body and a sheet member is omitted.
Figure 5:
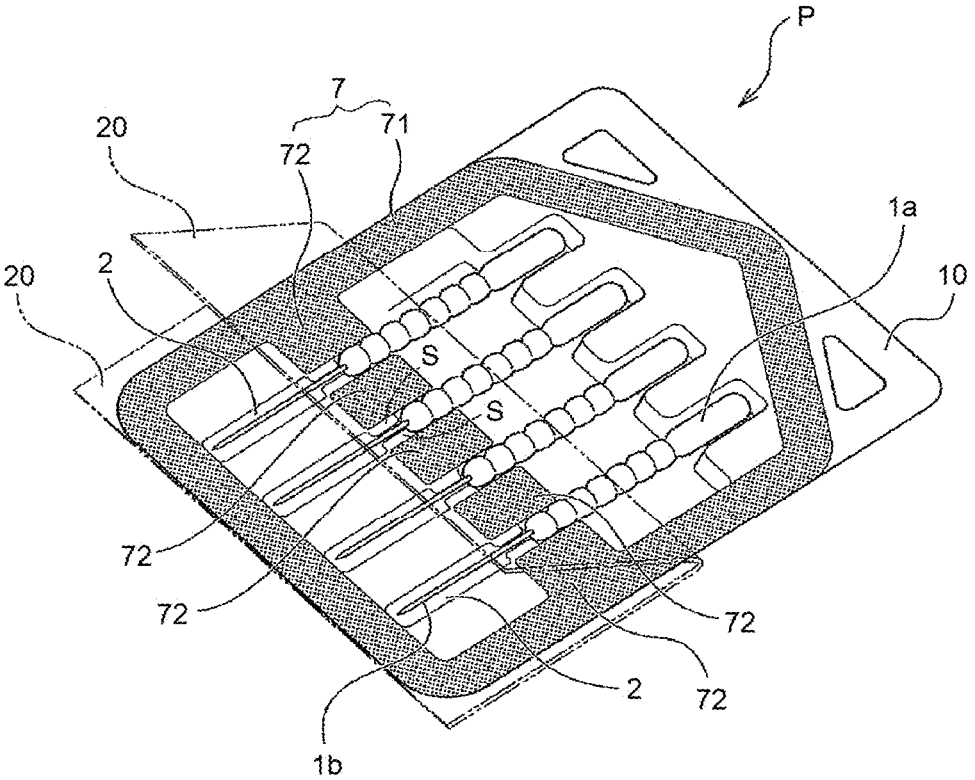
FIG. 5 is a schematic perspective view showing a state in which the sheet member of the acupuncture needle packaging container in FIG. 4 is peeled and the joining portion is shown in dots, wherein the joining portion between the container body and the sheet member is omitted.
Figure 6:
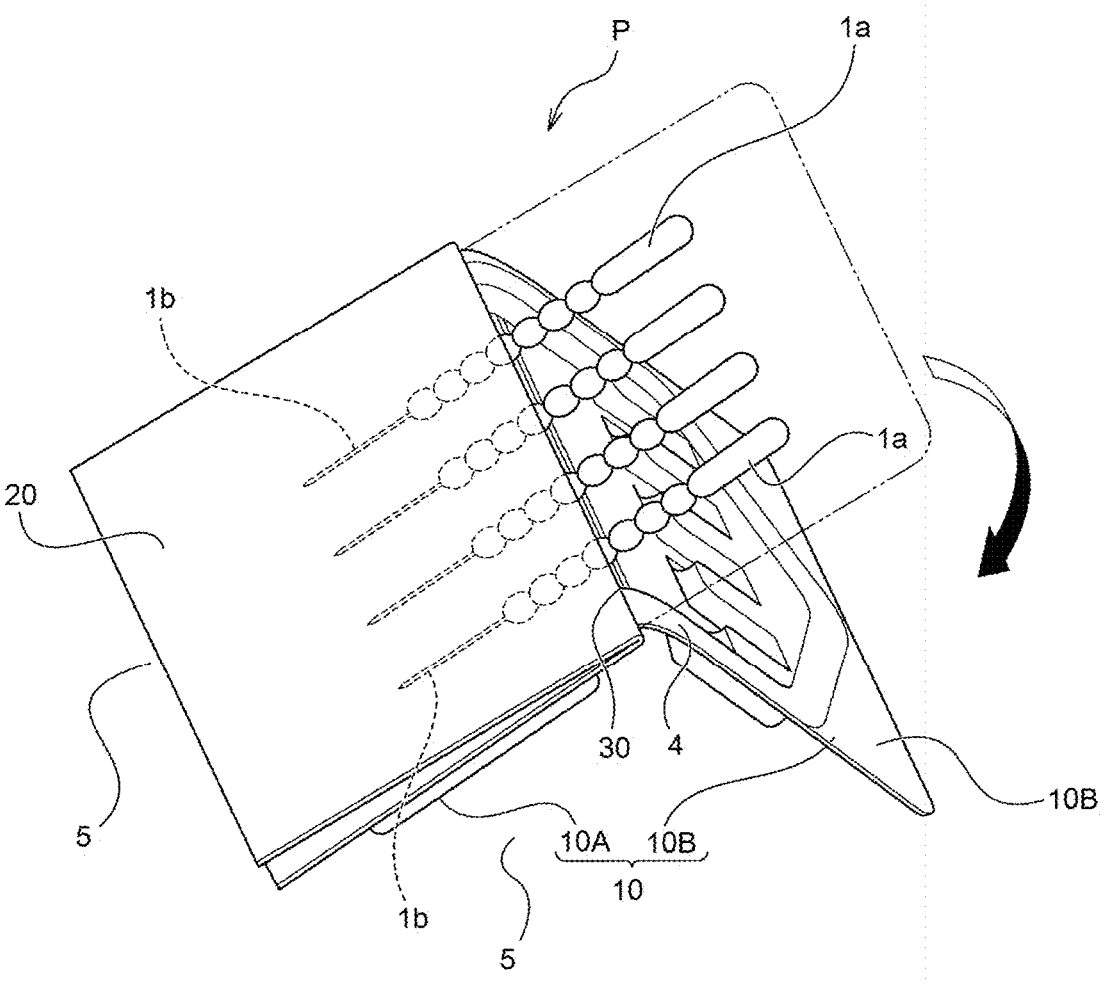
FIG. 6 is a schematic perspective view showing a state in which the container body of the acupuncture needle packaging container in FIG. 5 is bent in an inverted V-shape and placed on a mounting surface, wherein the joining portion between the container body and the sheet member is omitted.

Reference P shown in FIG. 1 refers to an acupuncture needle packaging container, and the acupuncture needle packaging container P has a plurality of storage recesses 2 (FIGS. 8 and 11 to 13) arranged side by side for accommodating acupuncture needles 1, a plate-shape container body 10 having a peripheral portion 4 being flat and protruding toward an outer periphery at a position higher than a bottom portion 3 of the storage recesses 2, and a sheet member 20 covering the container body 10 and detachably attached (for example, heat fusion by heat sealing) to the peripheral portion 4. (FIGS. 5 and 6).

A needle grip 1*a* is made of plastic or stainless steel, a needle body 1*b* of the acupuncture needle 1 is a linear body made of metal such as stainless steel and formed with a needle tip portion at a leading end thereof, and the needle body 1*b* has a thickness and a length suitable for therapeutic purposes, manual procedures, and the like. A thickness (wall thickness) of the needle body 2 is, for example, 0.10 mm to 0.35 mm, and the length is, for example, 15 mm to 150 mm.

Further, the container body 10 and the sheet member 20 are made of polypropylene, for example.

Figure 2:
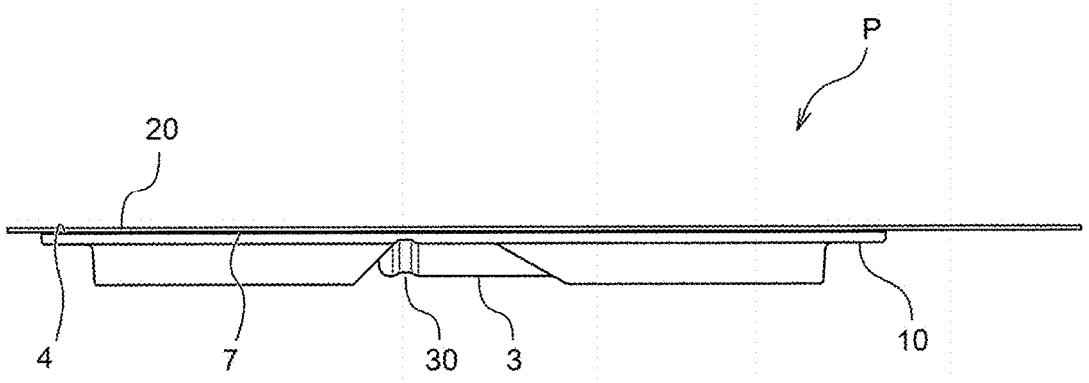
FIG. 2 is a schematic right side view of FIG. 1.
Figure 3:
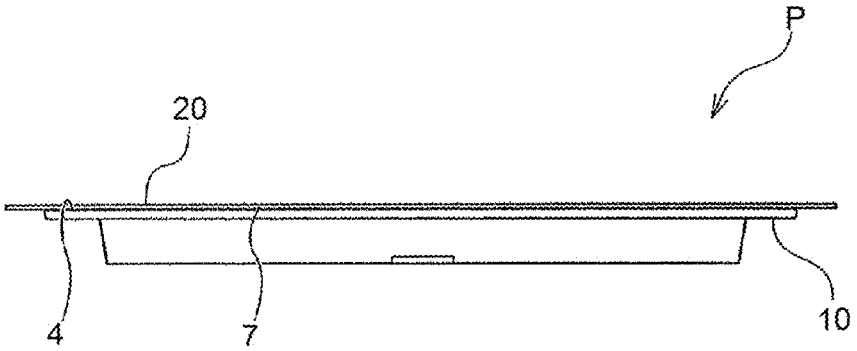
FIG. 3 is a schematic bottom view of FIG. 1.
Figure 9:
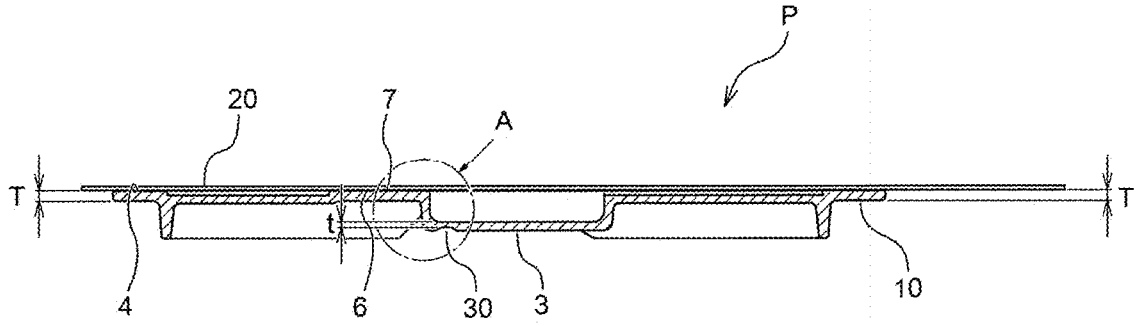
FIG. 9 is a schematic cross-sectional view taken along the line 9-9 in FIG. 8.
Figure 10:
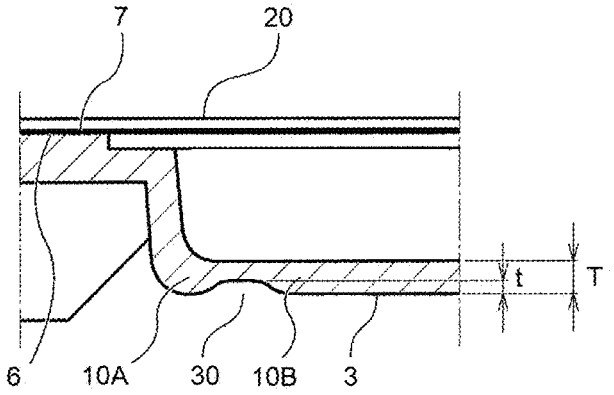
FIG. 10 is a schematic enlarged cross-sectional view showing the portion A in FIG. 9 in an enlarged view.
Figure 11:
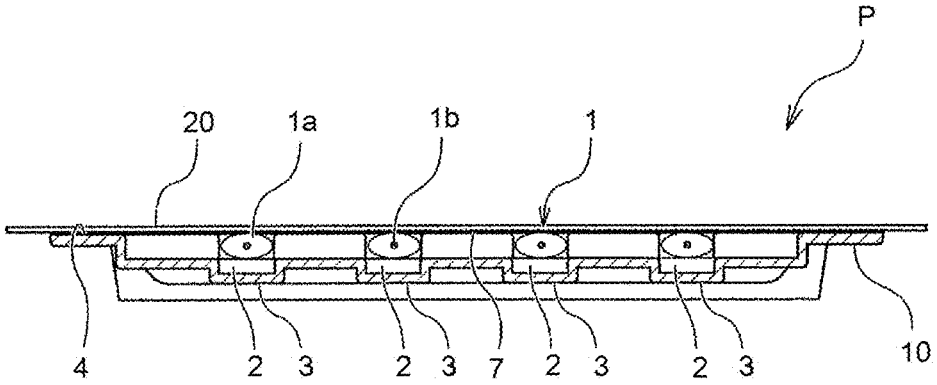
FIG. 11 is a schematic cross-sectional view taken along the line 11-11 in FIG. 8.
Figure 12:
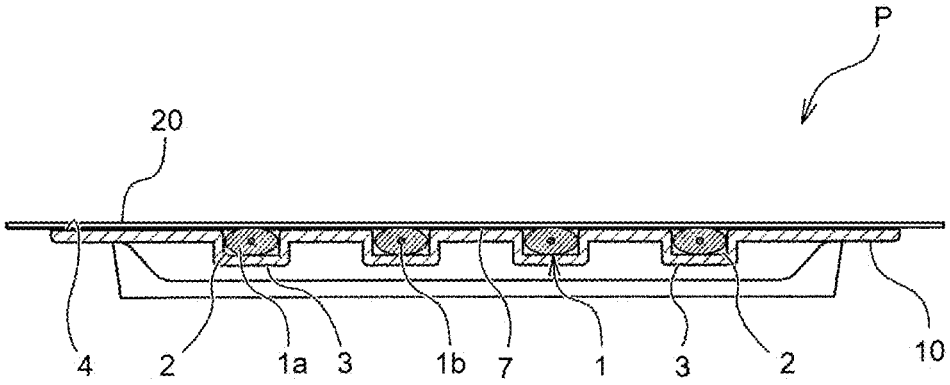
FIG. 12 is a schematic cross-sectional view taken along the line 12-12 in FIG. 8.

Reference 30 shown in FIGS. 2, 9 and 10 is an easily-bending portion (bendable portion) crossing a longitudinal direction of the needle grip 1*a* of the acupuncture needle 1 stored in the storage recesses 2 and provided at a bottom portion of the container body 10 below the needle grip 1*a*, and the acupuncture needles 1 are at least embedded and stored in the storage recesses 2.

The easily-bending portion 30 may be provided with an easily-bending portion in terms of material, but is structurally provided with a thin-walled easily-bending portion.

That is, the easily-bending portion 30 crosses the longitudinal direction of the acupuncture needle 1 stored in the storage recesses 2, and is provided linearly below the needle grip 1*a* of the acupuncture needle 1. The container body 10 is divided into a first container body 10A and a second container body 10B by the easily-bending portion 30. A thickness t between an upper surface and a lower surface of the easily-bending portion 30 (for example, 0.30 mm) is less than a thickness T between an upper surface and a lower surface of the first container body 10A and a thickness T between an upper surface and a lower surface of the second container body 10B (for example, 0.5 mm) (see FIG. 9).

More specifically, the thickness t (for example, 0.30 mm) between the upper surface and the lower surface of the easily-bending portion 30 is less than the thickness T between the upper surface and the lower surface of the first container body 10A at a portion adjacent to the easily-bending portion 30 and the thickness T (for example, 0.5 mm) between the upper surface and the lower surface of the second container body 10B at a portion adjacent to the easily-bending portion 30 (see FIG. 9).

Figure 13:
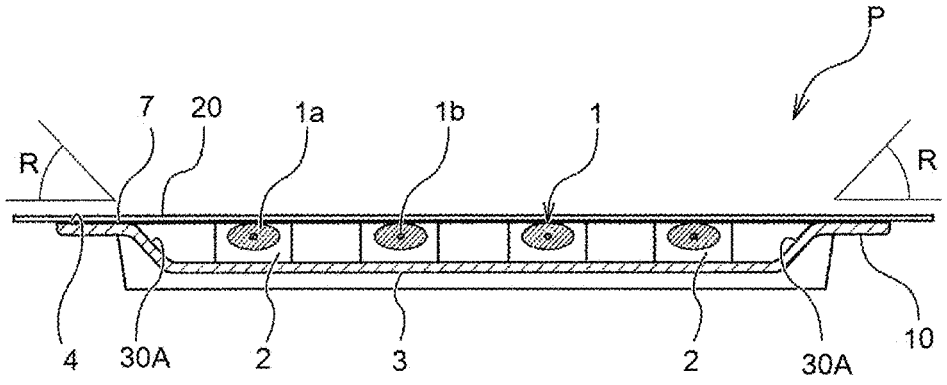
FIG. 13 is a schematic cross-sectional view taken along the line 13-13 of FIG. 8.

Further, as shown in FIG. 13, a side wall 30A of the easily-bending portion 30 is oblique (for example, an angle R formed by a bottom surface 3 and the side wall 30A is 45°), so that a strength of the container body 10 when bent at the easily-bending portion 30 is maintained.

That is, in the cross section of the easily-bending portion 30 crossing the longitudinal direction of the acupuncture needle 1, the side wall of the container body 10 is formed obliquely with respect to the bottom portion of the container body 10 toward the outer side of the container body 10. Therefore, a certain degree of strength can be maintained while being bent, and the easily-bending portion 30 provided on the container body 10 is positioned below, not the needle body 1*b*, but the needle grip 1*a* of the acupuncture needle 1, and at the portion bent, a load is applied to the needle grip 1*a* of the acupuncture needle 1 to protect the needle body 1*b*.

In a case in which the container body 10 is bent through the easily-bending portion 30 and the bent inverted V-shaped container body 10 is placed on the mounting surface 5, the container body 10 has a rigidity to maintain the inverted V-shape. (See FIGS. 6 and 7).

Figure 4:
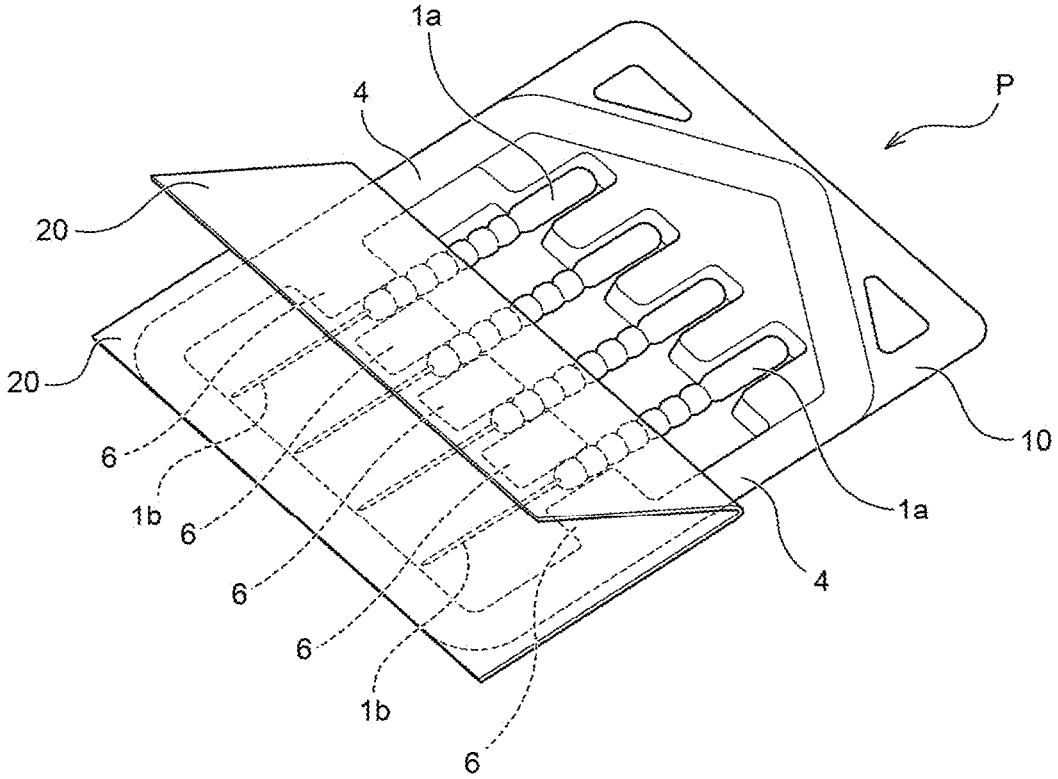
FIG. 4 is a schematic perspective view showing a state in which the sheet member of the acupuncture needle packaging container in FIG. 1 is peeled, wherein the joining portion between the container body and the sheet member is omitted.

According to the acupuncture needle packaging container P, because the easily-bending portion 30 is provided below the needle grip of the acupuncture needle 1 and crossing in the longitudinal direction of the acupuncture needle 1 stored in the storage recesses 2, even if the sheet member 20 is peeled in a direction from the needle grip 1*a* of the acupuncture needle 1 stored in the container body 10 toward the needle body 1*b* and then the container body 10 is bent in a direction opposite to the peeling direction of the sheet member 20, the needle body 1*b* of the acupuncture needle 1 is prevented from bending. In addition, for example, although not shown in the drawings, the bent plate-shaped container body 10 having a stiffness and the peeled sheet member 20 can be stably sandwiched between a middle finger and an index finger of the left hand, and the exposed needle grip 1*a* of the acupuncture needle 1 stored in the storage recesses 2 can be easily grasped with the right hand. As shown in FIGS. 4 and 5, the bent plate-shaped container body 10 having the stiffness is stably placed in an inverted V-shape on the mounting surface 5 to expose the needle grip 1*a* of the acupuncture needle 1 stored in the storage recesses 2 so that the exposed needle grip 1*a* of the acupuncture needle 1 stored in the storage recesses 2 can be easily grasped by hand. In addition, the needle body 1*b* does not need to be inside a cylinder, and after opening the packaging, the acupuncture needle 1 does not need to be replaced in a chalet or a needle plate. As shown in FIGS. 4 and 5, the needle grip 1*a* of the acupuncture needle 1 is exposed so that the acupuncture needles 1 can be easily taken out, and the needle body 1*b* of the acupuncture needle 1 is covered with the sheet member 20 until the acupuncture needle 1 is taken out, so that contamination can be prevented.

Also, peeling the sheet member 20 from the container body 10, bending the easily-bending portion 30 to bend the container body 10 in a direction opposite to the peeling direction of the sheet member 20, placing the bent container body 10 on the mounting surface 5 in an inverted V-shape, and exposing the needle grip 1*a* of the acupuncture needle 1 stored in the storage recesses 2 are "a method of mounting an acupuncture needle packaging container."

Figure 7:
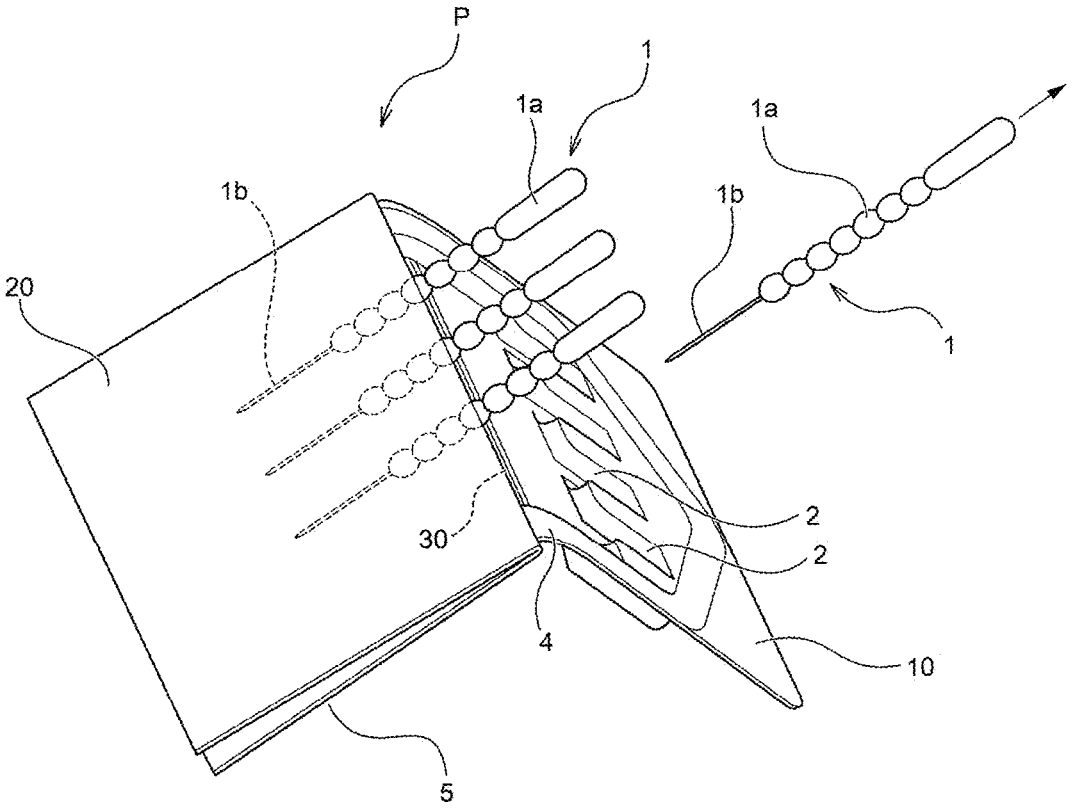
FIG. 7 is a schematic perspective view showing a state in which the acupuncture needles are taken out from the acupuncture needle packaging container in FIG. 6, wherein the joining portion between the container body and the sheet member is omitted.
Figure 8:
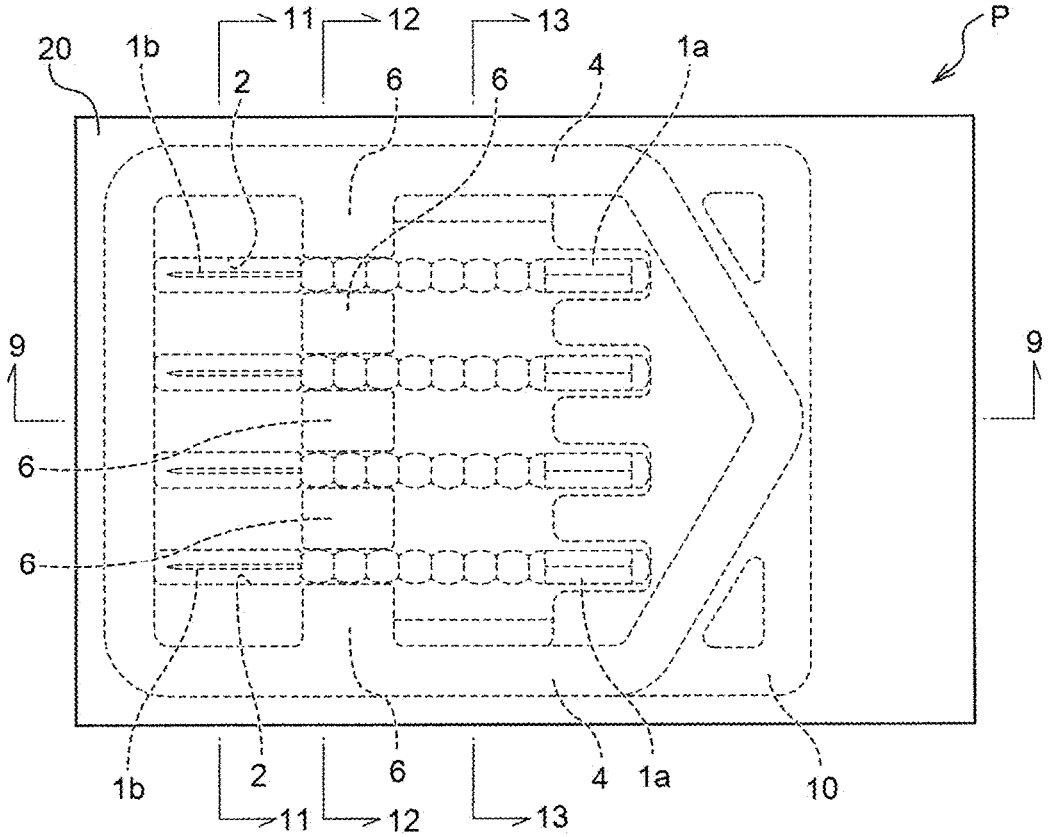
FIG. 8 is a schematic front view of FIG. 1, wherein the joining portion between the container body and the sheet member is omitted.

According to the method of mounting the acupuncture needle packaging container, as shown in FIGS. 6 and 7, the bent plate-shaped container body 10 having the stiffness can be stably mounted on the mounting surface 5 in an inverted V-shape; moreover, the exposed needle grip 1*a* of the acupuncture needle 1 stored in the storage recesses 2 can be easily grasped by hand.

Further, the dots shown in FIG. 5 is a joining portion 7 by heat sealing, and the joining portion 7 between the container body 10 and the sheet member 20 includes a peripheral joining portion 71 being a part of the joining portion between the sheet member 20 and the peripheral portion of the container body 10, and a crossing direction joining portion 72 being a part of the joining portion provided on an inner side of the peripheral joining portion 71 and provided in a direction crossing the longitudinal direction of the needle grip 1*a* of the acupuncture needle 1. The crossing direction joining portion 72 is provided, for example, at a top surface 6 of the container body 10.

The easily-bending portion 30 is positioned at a side farther than the crossing direction joining portion 72 when viewed from the needle tip of the acupuncture needle 1 stored in the storage recesses 2.

The portion applied with the joining portion 7 is above the needle grip 1*a* of the acupuncture needle 1 stored in the storage recesses 2, and at the top surface 6 between the adjacent storage recesses 2, the sheet member 20 is joined (for example, heat fusion by heat sealing) to the top surface 6 through the joining portion (see the portion indicated by dots in FIG. 5 for the joining portion).

At the joining portion 7 wherein the sheet member 20 is peeled from the container body 10 along the longitudinal direction of the needle grip 1*a* of the acupuncture needle 1 and reaches the easily-bending portion 30, the peripheral joining portion 71 is positioned at an outer side of the crossing direction joining portion 72.

The crossing direction joining portion 72 does not have to join with the peripheral joining portion 71; however, it is preferable that the crossing direction joining portion 72 has a joint portion joined to the peripheral joining portion 71.

Therefore, when peeling the sheet member 20 and when the peeled sheet member 20 reaches the crossing direction joining portion 72 to which the sheet member 20 and the top surface 6 are joining, an opening resistance increases and a warning against the peeling action is urged to possibly stop the peeling action so that an exposure of the needle body 1*b* of the acupuncture needle 1 can be prevented.

As shown in FIG. 4, a plurality of top surfaces 6 is formed. Further, in FIG. 4, the residue of the joining portion 7 after the sheet member 20 is peeled is omitted.

The above-mentioned description is also the method of placing the acupuncture needle packaging container.

That is, a plurality of storage recesses 2 for storing the acupuncture needle 1 arranged side by side; the container body 10 having the peripheral portion 4 positioned higher than the bottom portion of the storage recesses 2; the sheet member 20 covering the container body 10 and joined (for example, heat fusion) to the peripheral portion 4; and the easily-bending portion 30 below the needle grip 1*a* of the acupuncture needle 1 and provided on the container body 10 so as to cross the longitudinal direction of the acupuncture needle 1 stored in the storage recesses 2 are provided.

According to the method of placing the acupuncture needle packaging container, the sheet member 20 is peeled in a direction from the needle grip 1*a* of the acupuncture needle 1 stored in the container body 10 toward the needle body 1*b*, then the container body 10 is bent in an opposite direction to the peeling direction of the member 20 at the easily-bending portion 30, the bent container body 10 is placed on the mounting surface 5 in the inverted V-shape, and the needle grip 1*a* of the acupuncture needle 1 stored in the storage recesses 2 is exposed (see FIGS. 5 and 6).

According to this method of placing the acupuncture needle packaging container, the bent container body 10 having a stiffness can be stably placed on the mounting surface 5 in the inverted V-shape, and because the needle grip 1*a* of the acupuncture needle 1 stored in the storage recesses 2 is exposed, the needle grip 1*a* of the acupuncture needle 1 can be easily grasped by hand.

Figure 14:
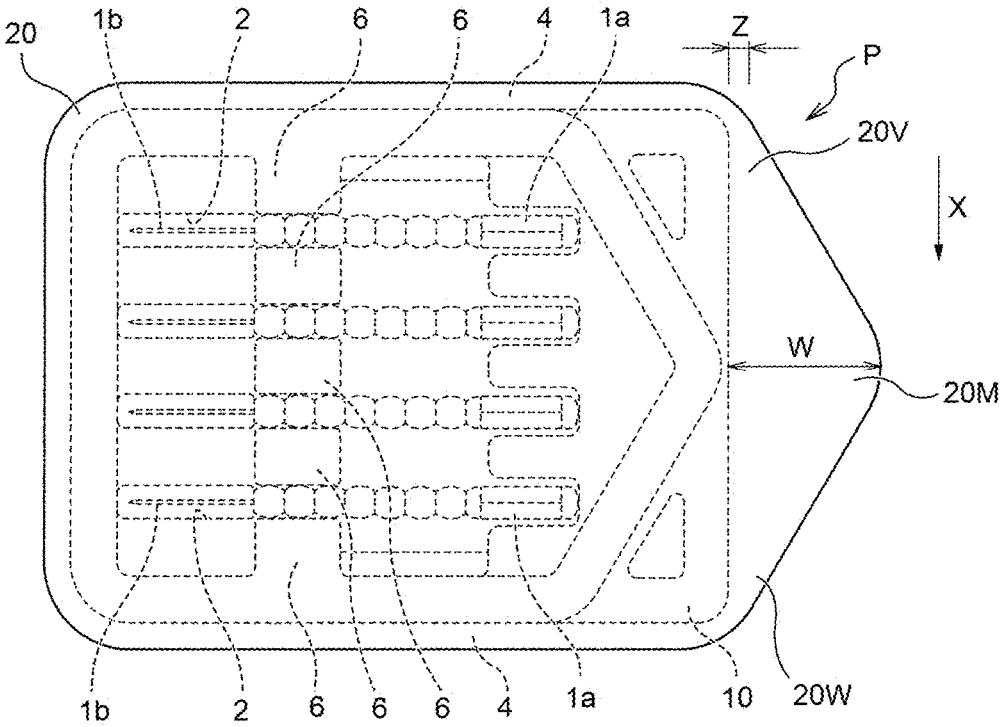
FIG. 14 is a schematic front view of the acupuncture needle packaging container in at least one further embodiment different from the acupuncture needle packaging container in FIG. 8, wherein the joining portion between the container body and the sheet member is omitted.

Next, at least one further embodiment of the acupuncture needle packaging container P different from the above-described at least one embodiment will be described (FIG. 14).

That is, a direction orthogonal to the longitudinal direction of the acupuncture needle 1 stored in the storage recesses 2 is an X direction. The X direction of the sheet member 20 is a width direction. Guiding means for guiding the peeling of the sheet member 20 in the longitudinal direction of the acupuncture needle 1 stored in the storage recesses 2 to allow grasp by hand is provided by having an end portion of the sheet member 20 protruding from the container body 10 at a side farther from the needle body 1*b* of the acupuncture needle 1, and having a protrusion amount, in the width direction of the sheet member 20, of a central portion 20M of the end portion from the container body 10 being large compared to a protrusion amount, in the width direction of the sheet member 20, of both end portions 20V and 20W of the end portion. That is, the protrusion amount W of the central portion 20M of the end portion in the width direction of the sheet member 20 is larger than the protrusion amount Z of the end portion of the sheet member 20.

This is due to the following reasons.

That is, if the protrusion amount of the end portion of the sheet member 20 from the container body 10 is constant, the width end (20V, 20W) of the sheet member 20 may be gripped and peeled by hand, therefore, a problem may occur wherein a peeling force may act from an oblique direction rather than an orthogonal direction with respect to the joining portion at the top surface 6 between the sheet member 20 and the adjacent storage recesses 2 causing the sheet member 20 to easily peel.

However, according to the acupuncture needle packaging container P, the end portion of the sheet member 20 on a side farther from the needle body 1*b* of the acupuncture needle 1 protrudes from the container body 10, and because the central portion 20M of the end portion in the width direction of the sheet member 20 has the protrusion amount from the container body 10 being large compared to that of the both end portions 20V, 20W of the end portion in the width direction of the sheet member 20, the finger of the hand can be guided to the portion 20M wherein the protrusion amount is large. When the peeling of sheet member 20 reaches the joining portion, the resistance increases and the peeling force acts against the joining portion from the orthogonal direction causing difficulty in peeling and stopping the peeling action so that the peeling does not exceed beyond the joining portion and the above-mentioned trouble can be prevented.

The acupuncture needle packaging container P is at least for storing and burying the acupuncture needle 1 in the storage recesses 2, and in a case in which the container body 10 is bent through the easily-bending portion 30 and the bent inverted V-shaped container body 10 is placed on the mounting surface 5, the container body 10 has a rigidity that can maintain the inverted V-shape. A stopper S is provided at the storage recesses 2, and by the stopper S, a movement toward a leading end side of the needle body 1*b* of the acupuncture needle 1 stored in the storage recesses 2 is prevented so that the leading end of the needle body 1*b* of the acupuncture needle 1 can be protected.

What is claimed is:

1. An acupuncture needle packaging container, comprising:

a plurality of acupuncture needles;

a container body having a plurality of storage recesses arranged side by side, wherein each of the plurality of storage recesses stores an acupuncture needle of the plurality of acupuncture needles, and a peripheral portion positioned higher than a bottom portion of the plurality of storage recesses;

a sheet member configured to cover the container body and attached to the peripheral portion; and a bendable portion crossing a longitudinal direction of a needle grip of each of the plurality of acupuncture needles, the bendable portion provided on the container body below the needle grip, wherein when the container body is bent, at the bendable portion, into an inverted V-shape and placed on a mounting surface, the container body has a rigidity to maintain the inverted V-shape, and in a cross section of the bendable portion along a direction crossing the longitudinal direction, a side wall of the container body, with respect to a bottom portion of the container body, is oblique toward an outer side of the container body.

2. The acupuncture needle packaging container according to claim 1, further comprising:

a guiding member configured to guide a peeling of the sheet member in the longitudinal direction, the guiding member comprising an end portion of the sheet member protruding from the container body on a side farther from a needle body of each of the plurality of acupuncture needles, wherein in a width direction of the sheet member, a protrusion amount of a central portion of the end portion from the container body is larger than a protrusion amount of two side end portions of the end portion.

3. The acupuncture needle packaging container according to claim 1, wherein when (a) the sheet member is peeled in a peeling direction from the needle grip of each of the plurality of acupuncture needle stored in the container body toward a needle body of the acupuncture needle and (b) the container body is bent at the bendable portion in a direction opposite to the peeling direction of the sheet member and placed on the mounting surface in the inverted V-shape, the needle grip of the acupuncture needle is exposed.

4. The acupuncture needle packaging container according to claim 1, further comprising:

a stopper, at said each of the plurality of storage recesses, configured to prevent a movement of each of the plurality of acupuncture needles toward a needle tip of the acupuncture needle.

5. An acupuncture needle packaging container, comprising:

a plurality of acupuncture needles;

a container body having a plurality of storage recesses arranged side by side, wherein each of the plurality of storage recesses stores an acupuncture needle of the plurality of acupuncture needles, and a peripheral portion positioned higher than a bottom portion of the plurality of storage recesses;

a sheet member configured to cover the container body and attached to the container body; and a bendable portion crossing a longitudinal direction of a needle grip of each of the plurality of acupuncture needles and provided on the container body below the needle grip, wherein a joining portion between the container body and the sheet member includes a peripheral joining portion between the sheet member and the peripheral portion of the container body, and a crossing direction joining portion on an inner side of the peripheral joining portion and extending in a direction crossing the longitudinal direction, the bendable portion is positioned on a side farther than the crossing direction joining portion when viewed from a needle tip of each of the plurality of acupuncture needles, when the sheet member is peeled from the container body along the longitudinal direction and the sheet member reaches the bendable portion, the peripheral joining portion is positioned on an outer side of the crossing direction joining portion, and the joining portion is configured to, when the sheet member is peeled in the longitudinal direction from the needle grip of each of the plurality of acupuncture needles toward the needle tip of the acupuncture needle, cause an opening resistance between the container body and the sheet member to increase at the crossing direction joining portion.

6. The acupuncture needle packaging container according to claim 5, wherein the crossing direction joining portion has a joint portion joined to the peripheral joining portion.

7. The acupuncture needle packaging container according to claim 5, further comprising a guiding member configured to guide a peeling of the sheet member in the longitudinal direction, the guiding member comprising an end portion of the sheet member protruding from the container body on a side farther from a needle body of each of the plurality of acupuncture needles, wherein in a width direction of the sheet member, a protrusion amount of a central portion of the end portion from the container body is larger than a protrusion amount of two side end portions of the end portion.

8. The acupuncture needle packaging container according to claim 5, wherein when (a) the sheet member is peeled in a peeling direction from the needle grip of each of the plurality of acupuncture needles stored in the container body toward a needle body of the acupuncture needle and (b) the container body is bent at the bendable portion in a direction opposite to the peeling direction of the sheet member and placed on the mounting surface in the inverted V-shape, the needle grip of the acupuncture needle is exposed.

9. The acupuncture needle packaging container according to claim 5, wherein when the container body is bent, at the bendable portion, into an inverted V-shape and placed on a mounting surface, the container body has a rigidity to maintain the inverted V-shape, and a stopper, at said each of the plurality of storage recesses, is configured to prevent a movement of each of the plurality of acupuncture needles toward the needle tip of the acupuncture needle.

* * * * *